US005920928A

United States Patent [19]

Piretti

[11] Patent Number: 5,920,928

[45] Date of Patent: Jul. 13, 1999

[54] SOFA CONVERTIBLE INTO BED

[75] Inventor: Giancarlo Piretti, Bologna, Italy

[73] Assignee: Desital Holland B.V., Amsterdam, Netherlands

[21] Appl. No.: 08/869,985

[22] Filed: Jun. 5, 1997

[30] Foreign Application Priority Data

Jun. 5, 1996 [IT] Italy ..... TO96A0491

[51] Int. Cl.[6] ..... A47C 17/13

[52] U.S. Cl. ..... 5/18.1; 5/53.2

[58] Field of Search ..... 5/18.1, 17, 53.2, 5/634

[56] References Cited

U.S. PATENT DOCUMENTS

| | | | |
|---|---|---|---|
| 2,568,366 | 9/1951 | Rosen | 5/18.1 |
| 3,019,454 | 2/1962 | Luca | 5/17 |
| 4,204,287 | 5/1980 | Lane et al. | 5/18.1 |
| 4,481,684 | 11/1984 | Hauck | 5/18.1 |
| 4,586,206 | 5/1986 | Singer | 5/18.1 |

FOREIGN PATENT DOCUMENTS

| | | | |
|---|---|---|---|
| 2094138 | 9/1982 | United Kingdom | 5/634 |

*Primary Examiner*—Alex Grosz

*Attorney, Agent, or Firm*—Sughrue, Mion, Zinn, Macpeak & Seas, PLLC

[57] ABSTRACT

The sofa according to the invention can be converted into bed by drawing forwardly the supporting structure until it reaches an elongated condition in which the mattress lies down thereon. In the retracted condition for use as sofa, the mattress is folded under the supporting structure.

3 Claims, 7 Drawing Sheets

SOFA CONVERTIBLE INTO BED

BACKGROUND OF THE INVENTION

The present invention relates to a sofa convertible into bed, of the type comprising a backrest and a seat portion which includes a supporting structure and a mattress resting thereon.

SUMMARY OF THE INVENTION

The object of the invention is that of providing a sofa which can be converted into bed and viceversa with extremely simple and rapid operations, enabling a relevant comfort for the user both in the sofa configuration and in the bed configuration, and finally having a simple and inexpensive structure which however is also effective and reliable.

In order to achieve this object, the invention provides a sofa of the type indicated at the beginning, characterized in that said supporting structure of the seat portion of the sofa includes a fixed portion and a portion which is movable horizontally and forwardly with respect to fixed portion, starting from a retracted position corresponding to a shortened configuration of the supporting structure for use as sofa, towards a forwardly displaced position, corresponding to an elongated configuration of the supporting structure, for use as bed, and in that said mattress has one end portion anchored to said movable portion, so that it lies down over the supporting structure in the elongated condition thereof, for use as bed, whereas in the shortened configuration of the supporting structure, for use as sofa, said end portion of the mattress constitutes the sofa seat, whereas the remaining portion of,the mattress is folded below said supporting structure, and further in that said fixed portion of the supporting structure includes means for guiding the mattress between its unfolded condition and its folded condition.

Due to the above indicated features, the sofa according to the invention can be converted into bed with an extremely simple and rapid operation, by displacing said movable portion of the supporting structure forwardly until the unfolded bed configuration is achieved, in which the mattress lies down over said supporting structure. By moving the supporting structure back to the sofa shortened configuration, the end portion of the mattress which is fixed over the movable portion of the supporting structure becomes the sofa seat, whereas the remaining portion of the mattress is folded under the supporting structure.

The sofa according to the invention can be provided in different lengths, depending from whether a single or double bed is to be obtained. Particularly in the single bed embodiment, a further advantage of the invention lies in that by positioning the movable portion of the supporting structure of the sofa at an intermediate position between said retracted and forwardly displaced positions, a seat configuration of the "chaise-longue" type or deck-chair type is obtained.

In a preferred embodiment, said movable portion of the sofa supporting structure is slidably mounted with respect to an intermediate portion of the supporting structure, which on its turn is slidably mounted with respect to said fixed portion. Yet in the preferred embodiment, said fixed portion includes supporting legs, whereas the movable portion is provided with wheels, the intermediate portion being instead suspended between said fixed portion and said movable portion. Preferably, said fixed portion, said intermediate portion and said movable portion are mutually slidably mounted by the engagement of rollers within respective guiding profiles.

Yet in the afore-said preferred embodiment, the mattress guiding means comprises two parallel and spaced apart guiding rails which are arranged according to U-shaped paths having horizontal runs, lying in two parallel planes, said rails being engaged by guiding rollers carried by the ends of strengthening rods anchored to the lower face of the mattress.

According to a further preferred feature of the invention, the said fixed portion of the sofa supporting structure includes an auxiliary backrest supporting structure. Said backrest includes a foldable frame carried by said auxiliary supporting structure. The foldable frame includes a frame which strengthens the upper part of the backrest, connected to said auxiliary supporting structure by a parallelogram linkage, so that the backrest can be moved between an unfolded upright condition, in which it is used as bed headrest, and a condition folded around an intermediate horizontal axis according to a forwardly pointing arrow-like shape, with its lower part resting over the mattress and the upper part acting as a backrest for the sofa.

BRIEF DESCRIPTION OF THE DRAWINGS

Further features and advantages of the invention will become apparent from the description which follows with reference to the annexed drawings given purely by way of non limiting example, in which.

DETAILED DESCRIPTION OF THE INVENTION

Figure 1:
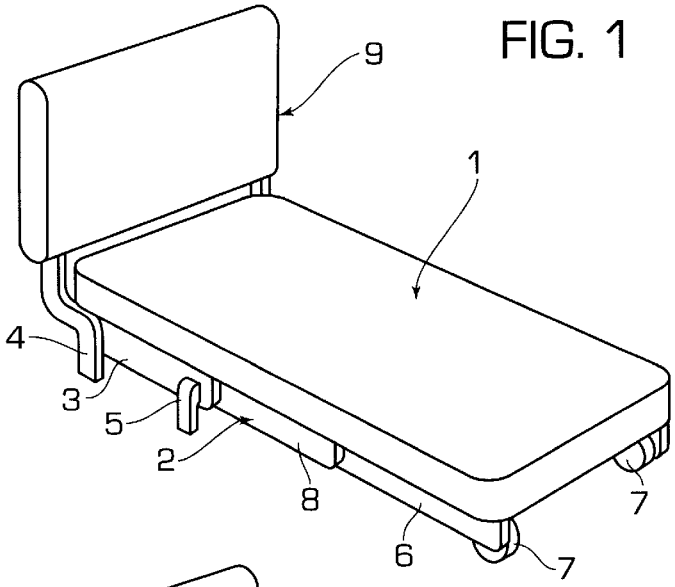
FIG. 1 is a perspective view of a sofa according to the invention in the condition converted into bed, according to the single bed version.
Figure 2:
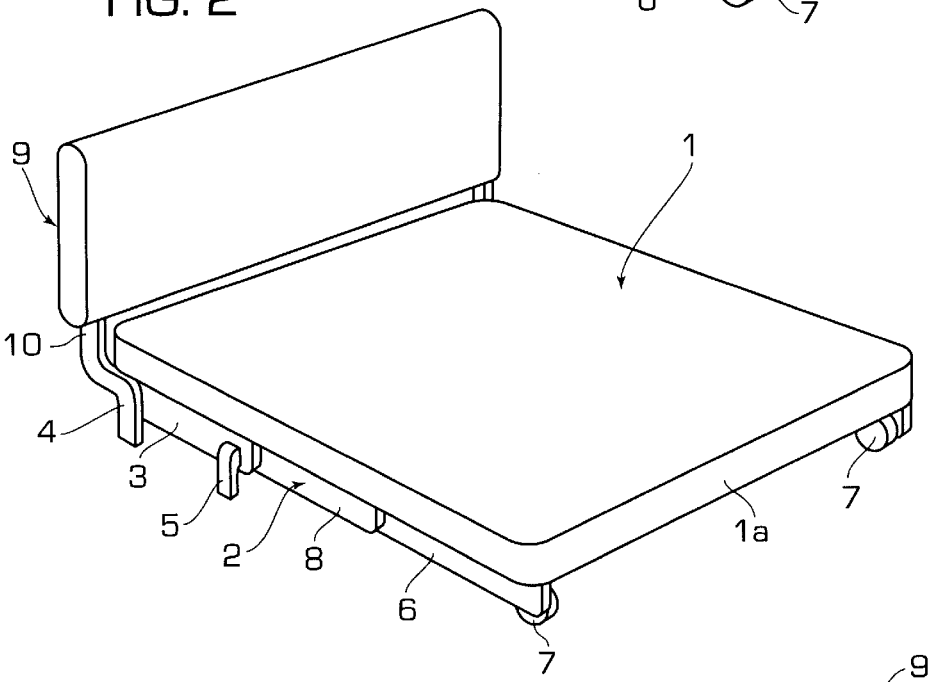
FIG. 2 shows the variant of FIG. 1 corresponding to the double bed version.

With reference to FIGS. 1, 2, which respectively show the two variants as single bed and double bed, of the sofa-bed according to the invention, in both cases, the latter comprises a mattress 1, which in the condition converted into bed shown in FIGS. 1, 2, lies down over a supporting structure 2. This supporting structure 2 can be shortened, starting from the unfolded condition shown in FIGS. 1, 2, until it comes to the retracted configuration shown in FIG. 3 (which relates to the variant of FIG. 1, the retracted configuration of the double bed of FIG. 2 being identical) and in FIG. 6.

In the embodiment shown herein, the extendable supporting structure 2 comprises a fixed portion 3, provided with two rear supporting legs 4 and two front supporting legs 5, and a movable portion 6, provided with two wheels 7, which is horizontally slidably mounted along the longitudinal direction of the bed with respect to an intermediate portion 8 which on its turn is slidably mounted on the fixed portion 3, as it will be illustrated more in detail in the following. In the condition converted into bed, the three portions 3, 8, 6 of the supporting structure 2 are arranged one on the extension of the other, so that the structure 2 takes the unfolded configuration shown in FIGS. 1, 2 and mattress 1 lies down thereon. In the condition converted into bed, the three structures 6, 8, 3 are arranged one inside the other (as it will be illustrated more in detail in the following) so that the structure 2 takes the retracted condition shown in FIGS. 3, 6. The mattress 1 has its end portion 1*a* which is arranged over the movable portion 6 of the supporting structure 2 and is anchored to the latter so as to follow the movements thereof. Therefore, when the supporting structure 2 is brought from the extended condition shown in FIGS. 1, 2 to the retracted condition shown in FIGS. 3, 6, the end portion 1*a* follows the movable part 6 until it takes the position shown in FIGS. 3, 6 in which it constitutes the sofa seat. In this condition, the remaining part of the mattress is folded under the supporting structure 2, as it is clearly visible, for example, in FIG. 6.

Figure 6:
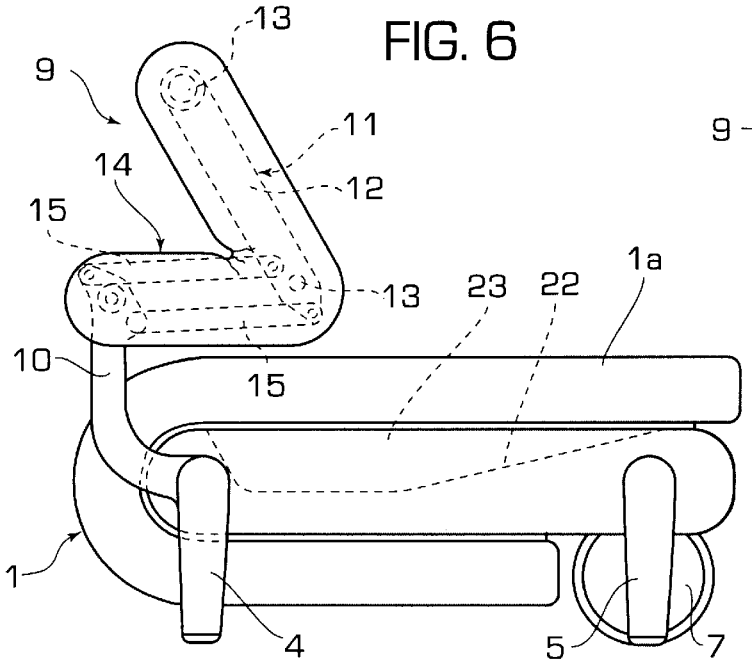
FIG. 6 is a side view, partially in cross-section, of the sofa of FIG. 3.
Figure 7:
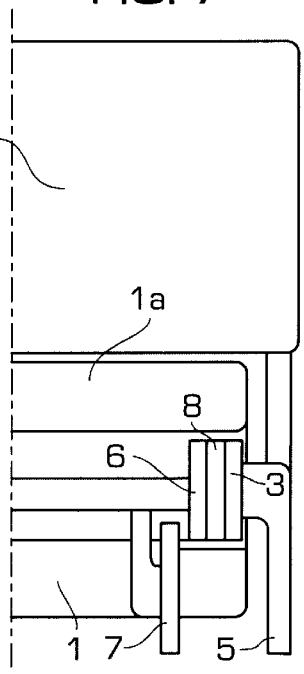
FIG. 7 is a partial front view of the sofa of FIG. 6.

Finally, the sofa-bed according to the invention has a backrest-headrest 9 carried by two supporting arms 10 which are connected to the rear supporting legs 4. As shown in FIG. 6, the upper part of the backrest 9 has a frame 11 constituted by two side arms 12 connected to each other by two tubular cross-members 13, this frame 11 being on its turn connected to the upper ends of the two supporting arms 10 by two parallelogram linkages 14 each comprising two articulated levers 15. Therefore, the backrest 9 is able to take either the flat condition lying in a vertical plane, shown in FIGS. 1, 2, in which it constitutes the bed headrest, or the condition folded according to a forwardly pointing arrow-like profile, with the lower portion of the backrest resting on mattress 1 (FIGS. 3, 6) and the upper portion of backrest 9 which constitutes the backrest proper of the sofa. Also the two upper ends of the supporting arms 10 are connected to each other by a tubular cross member 13.

Figure 3:
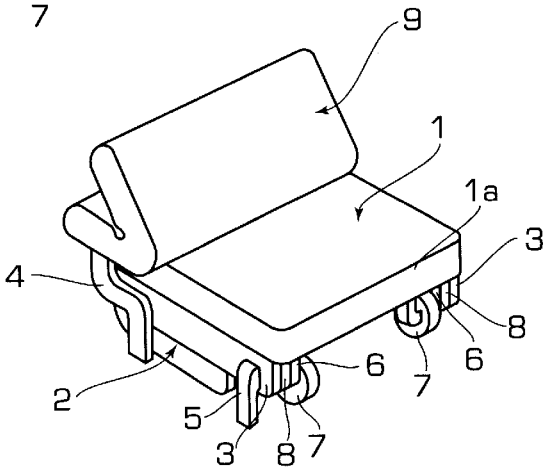
FIG. 3 is a perspective view of the sofa of FIG. 1 in the shortened condition for use as sofa.
Figure 8:
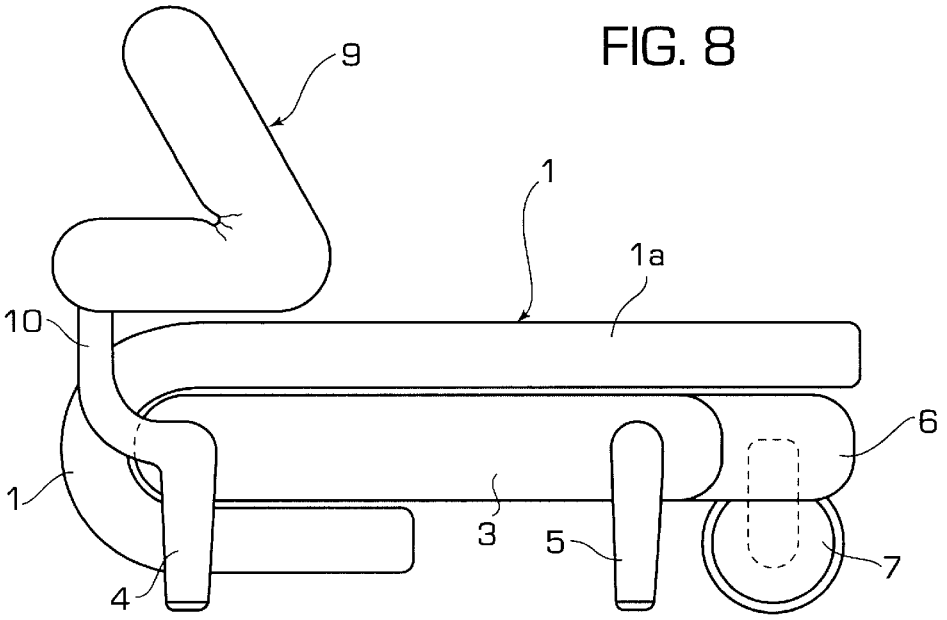
FIG. 8 is a side view of the sofa of FIG. 3 in a condition only partially unfolded, corresponding to the use as "chaise-longue" or deck-chair.
Figure 9:
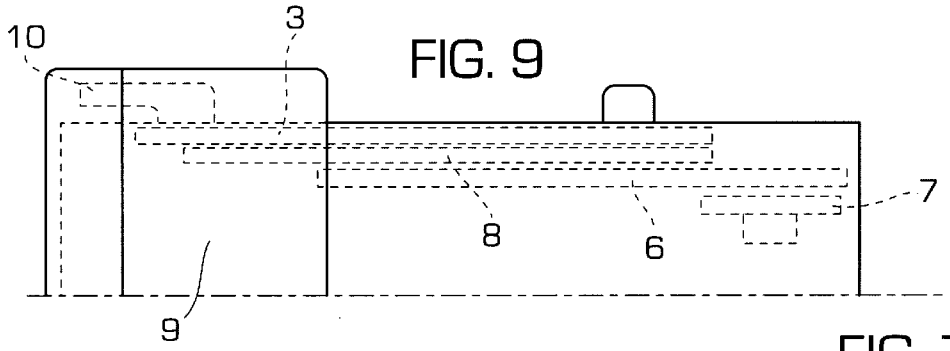
FIG. 9 is a partial plan view of the sofa in the condition of FIG. 8.

FIG. 8 shows the sofa-bed of FIGS. 1, 3 in a partially elongated condition, which is intermediate between the fully shortened position for use as sofa and the fully elongated position for use as bed. In the partially elongated condition shown in FIG. 8, the furniture according to the invention can be used as deck-chair or "chaise-longue".

FIGS. 5 and 10–17 show in detail the structure of sofa-bed according to the invention in its preferred embodiment.

Figure 4:
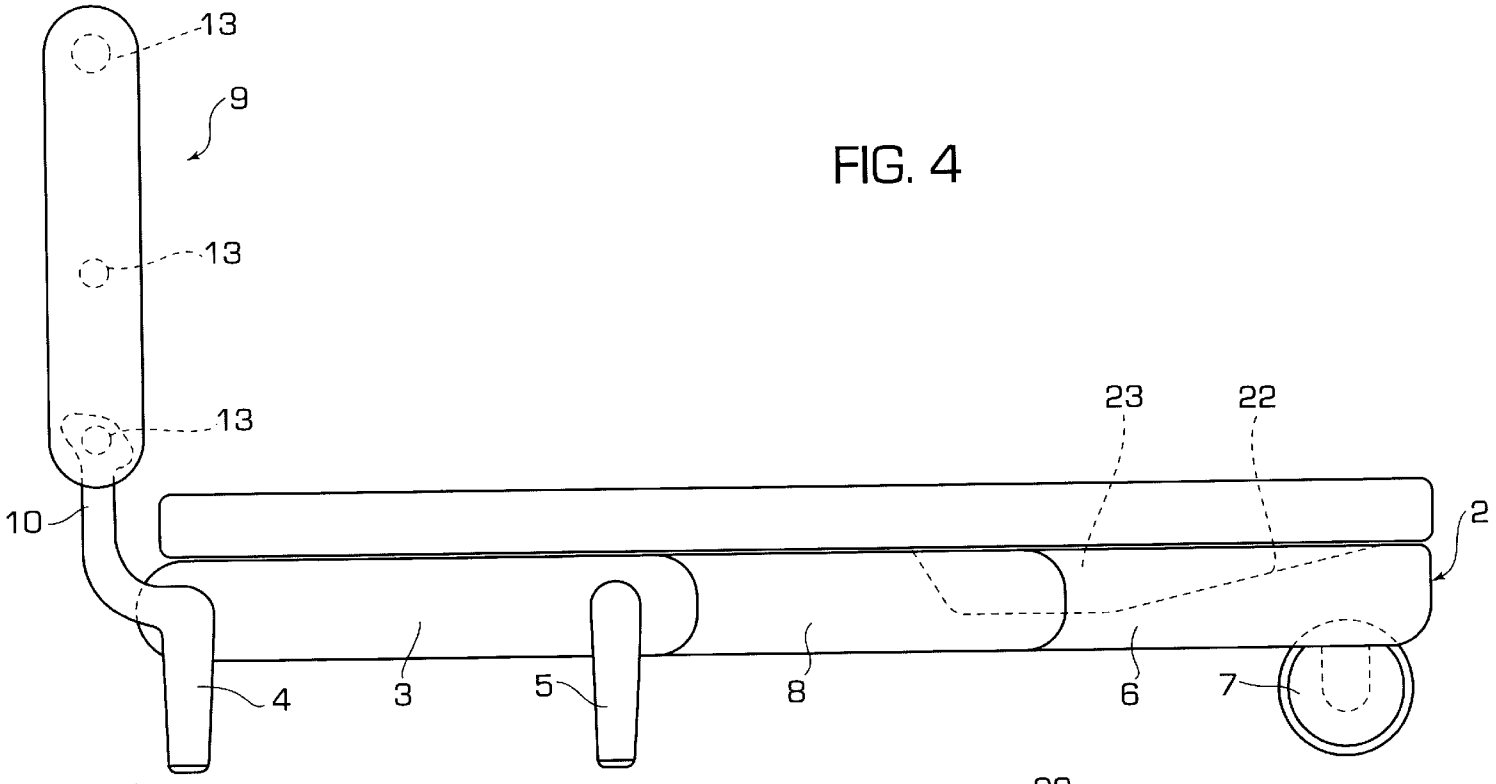
FIG. 4 is a side view of the bed of FIG. 1.
Figure 5:
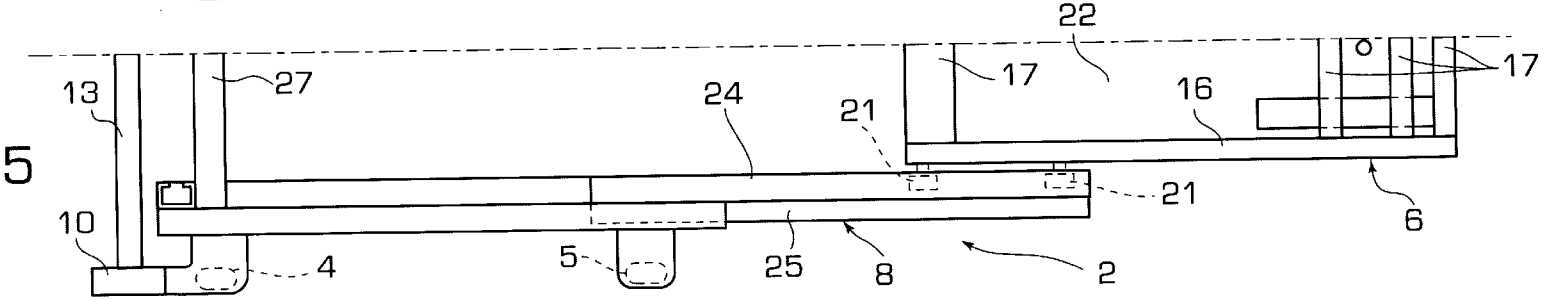
FIG. 5 is a partial plan view of the supporting structure of the bed of FIG. 1.
Figure 10:
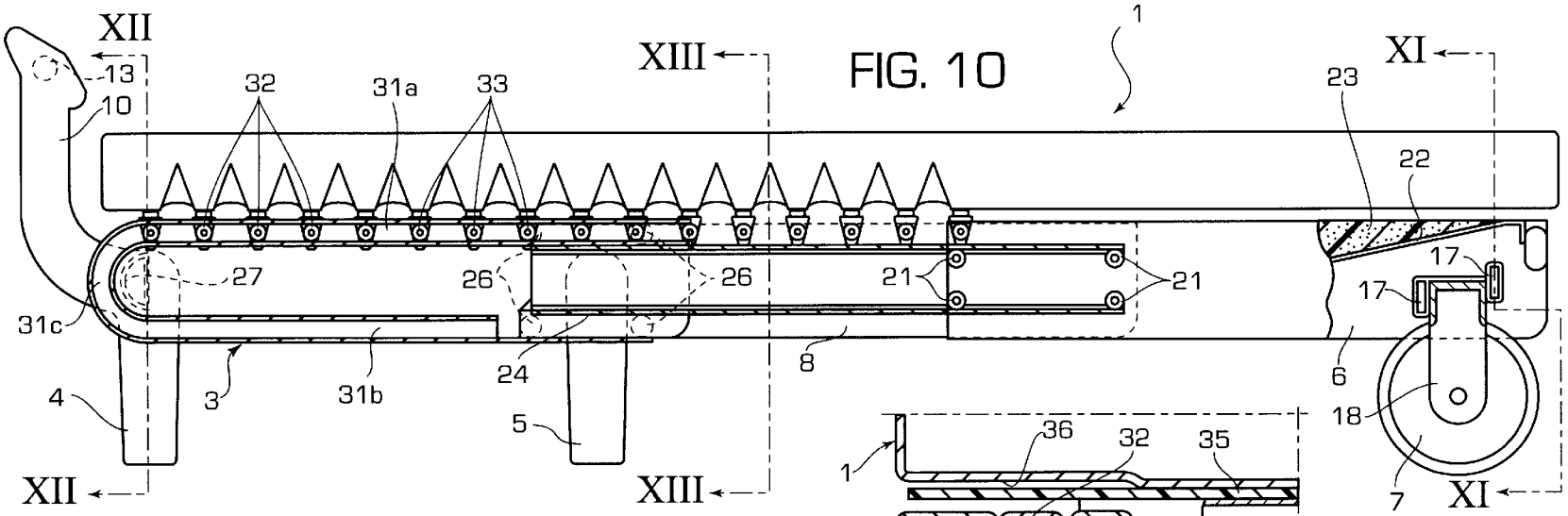
FIG. 10 is a partial side view, partially in cross-section, of the bed of FIG. 4, FIGS. 11, 12 and 13 are views in cross-section, taken along lines XI, XII and XIII of FIG. 10.
Figure 17:
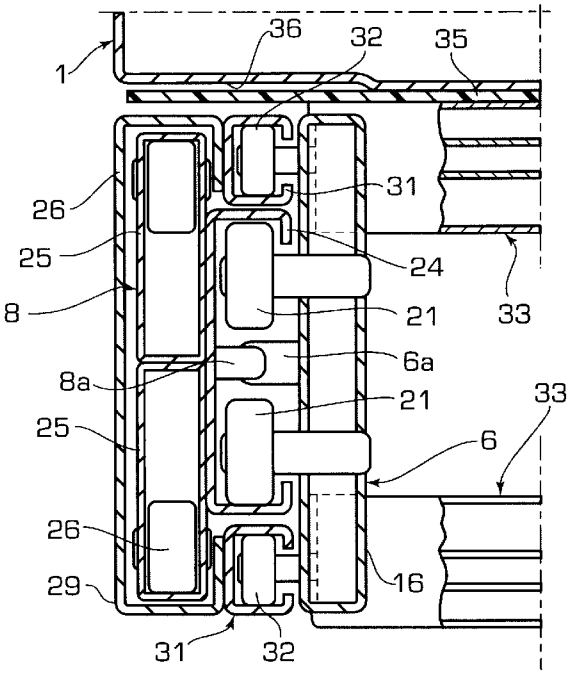
FIG. 17 is a cross-sectional view taken along line XVII—XVII of FIG. 16, FIGS. 18, 19 show a variant of the frame of the backrest, respectively in the two configurations as sofa and bed.
Figure 11:
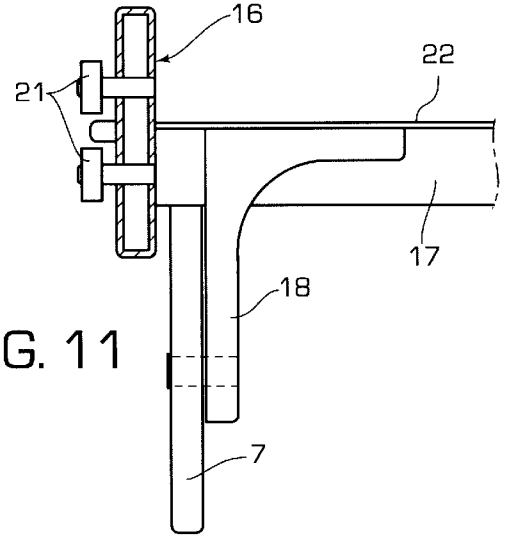
Figure 12:
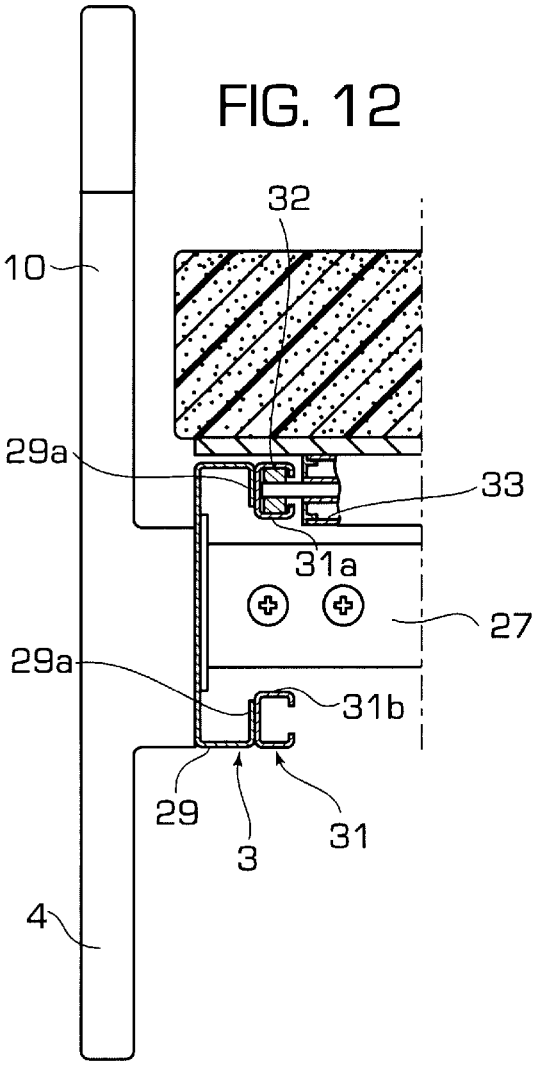
Figure 13:
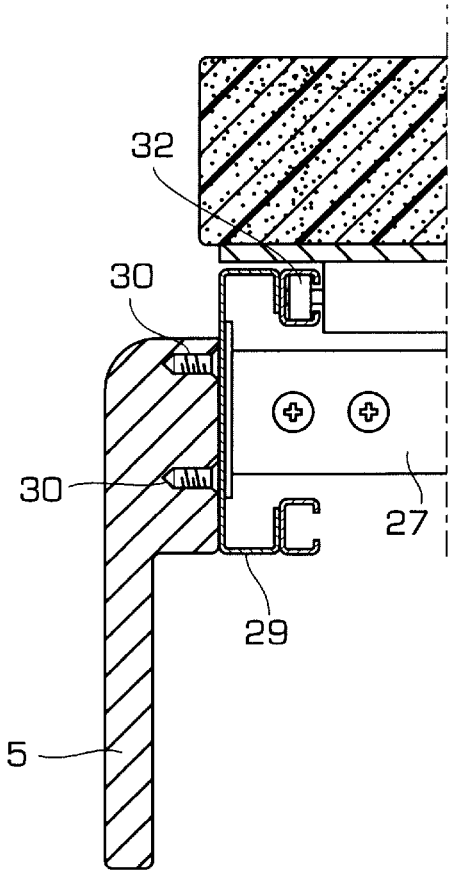
Figure 14:
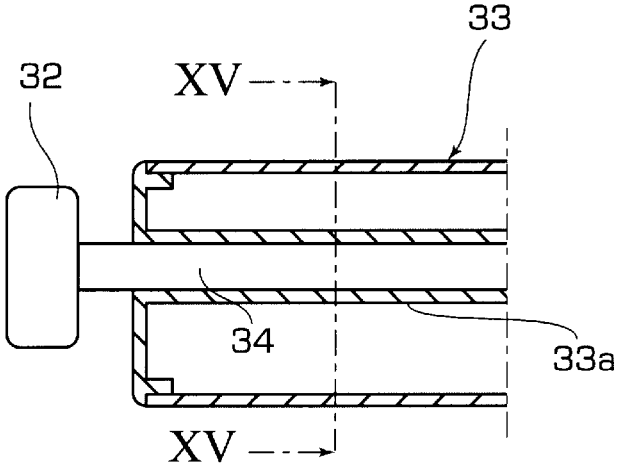
FIG. 14 is a partial view in cross-section, of a strengthening rod of the mattress of the sofa-bed according to the invention.
Figure 15:
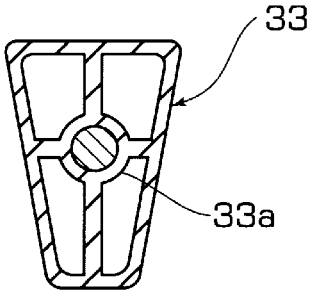
FIG. 15 is a view in cross-section taken along line XV—XV of FIG. 14.

With reference in detail to FIGS. 5, 11 and 17, the movable part 6 of the supporting structure 2 comprises two side longitudinal beams 16, for example of sheet metal, each having an hollow rectangular cross-section which is vertically elongated (FIGS. 11, 17),said beams being connected to each other by cross-members 17 (see also FIG. 10). Two of these cross members support two legs 18, whose lower ends respectively support two wheels 7 freely rotatably around an axis 20. Furthermore, the two longitudinal beams 16 carry two pairs of freely rotatable rollers 21 on their outer faces. The two longitudinal beams 16 are also connected to a supporting metal sheet 22 (FIGS. 4, 6, 10) defining a cavity which is filled with padding material 23 (such as foamed plastic material) to provide adequate support to the occupant of the sofa when the latter is in the shortened condition of FIG. 6, in which the padding 23 is arranged below the portion la of the mattress, constituting the sofa seat.

With reference to FIGS. 5, 10 and 17, the intermediate portion 8 of the supporting structure comprises, on each side, a sheet metal profile 24, having a C-shaped vertically elongated cross-section, within which there are engaged the rollers 21 carried by the corresponding side of the movable structure 6, said profile having its open side facing towards the respective side of structure 6 (FIG. 17) and its outer side welded to two further rectangular profiles 25 which are superimposed and aligned on each other, which on their turn carry two pairs of freely rotatable rollers 26 projecting through slots formed in the upper and lower walls of the respective profiles 25. Therefore, the movable part 6 of the supporting structure 2 is slidable with respect to the intermediate portion 8 as a result of a rolling of rollers 21 within the C-shaped profile 24 provided on each side of the intermediate structure 8. The two sides of the intermediate structure 8 are not connected to each other by cross-members, since they must enable the movable structure 6 to be retracted therebetween. These sides thus form two separate structures which are suspended on one side to the movable part 6 and on the opposite side, as it will shown in the following, to the fixed portion 3. In spite of this, from a theoretical point of view, these sides are considered as a single structure in the present description and in the claims which follow.

The fixed part 3 of the supporting structure 2 includes, as shown, the two rear legs 4 and the two front legs 5. The rear legs 4 are connected to each other at their upper ends by a cross-member 27 (see also FIGS. 12, 13). The fixed structure 3 includes two side longitudinal beams 29 fixed by screws 30 (FIGS. 12, 13) to the legs 4, 5 and each constituted by a sheet metal profile with a vertically elongated C-shaped cross-section, having two inwardly bent wings 29*a*. To these wings there is welded, on each side of the structure, a guiding rail 31 having a C-shaped cross-section, having a general U-shaped configuration arranged in a vertical longitudinal plane, with an upper horizontal run 31*a* and a lower horizontal run 31*b* connected to each other by an intermediate curved portion 31*c*. The two guiding rails 31 arranged on both sides of the fixed structure 3 are engaged by freely rotatable rollers 32 (FIGS. 10, 12–17) carried by the ends of strengthening rods 33 fixed to the lower surface of mattress 1.

Each rod 33 is constituted by a profile, for example of plastic material (FIG. 15), having a trapezium-shaped cross-section and including a cylindrical core 33*a* which rotatably supports a shaft 34 carrying a respective roller 32 at each end. On the major base of each profile 33 there is fixed (e.g. welded) a web of plastic material 35 which is glued to the lower surface of mattress 1, except for a portion thereof at each end (FIG. 17) which is spaced apart from the facing surface of the mattress 1 so as to define a gap 36 which is for receiving a hem of the bed-cover which covers the mattress and for protecting the bed cover from the risk of damage during the sofabed converting operation. The mattress 1 further comprises, on its lower side, inserts of soft plastic material 37, for example polyurethane, constituted by rods with a triangular cross-section, which have a reduced width in the curved portion of the mattress (see FIG. 16) when the latter is folded under the sofa supporting structure, in the sofa converted configuration.

Figure 16:
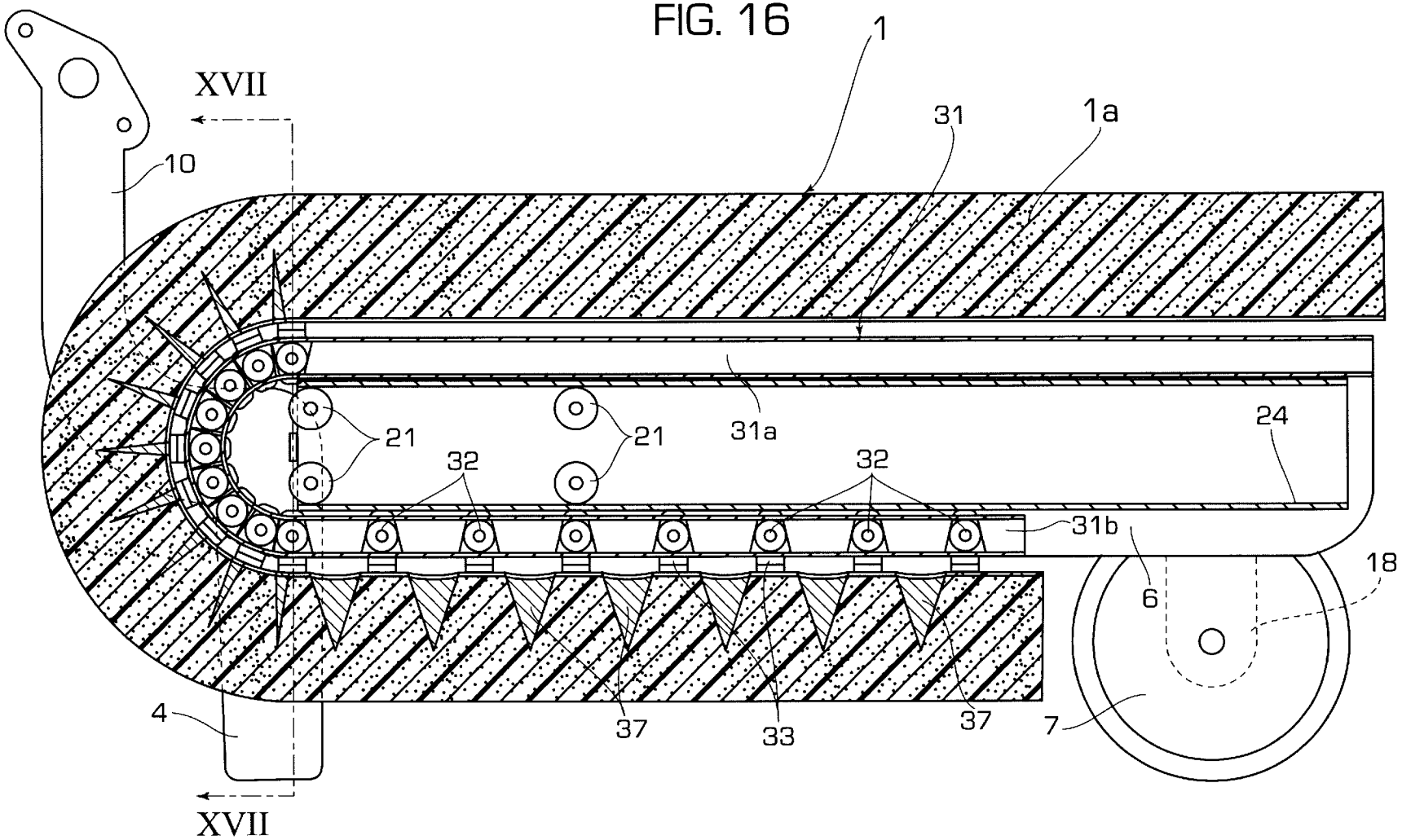
FIG. 16 is a partial view and at an enlarged scale, partially in cross-section, of the sofa-bed according to the invention in the condition of FIG. 6.

The operation of the sofa-bed according to the invention clearly appears from the foregoing description. When the supporting structure 2 is in the retracted condition for use as sofa (see FIGS. 3, 6, 16) the three portions 6, 8, 3 are arranged one inside the other, so as to take their configuration of minimum length. In this condition, the mattress 1 is partially bent under the supporting structure 2, as shown in FIG. 16. Starting from this condition, the user may grasp the front part of the sofa and draw it forwardly by causing the wheels to roll on the floor. The movable part 6 thus slides with respect to the intermediate part 8 up to mutual engagement of end stops 6, 8 (FIG. 17), whereupon a further forward movement of the movable portion 6 causes the simultaneous movement of the intermediate portion 8 until the fully extended condition shown in FIGS. 1 or 2, 4, 5 and 10 is reached. The backrest 9 can be brought from the bent condition shown in FIGS. 3, 6 to the extended condition shown in FIGS. 1 or 2 and 4, so as to convert it into headrest for the bed. During the above described movement of the supporting structure 2, the end portion la which is anchored to the movable portion 6 follows the latter causing rolling of rollers 32 in the guiding rail 31, until the mattress 1 is fully extracted in the extended condition shown in FIG. 10. When the bed has to be converted into sofa, it is necessary of course to follow the reverse process, with the further possibility of stopping the movable portion 6 in the partially extracted condition shown in FIG. 8, for use as "chaise-longue".

From the foregoing description, it clearly appears that in the sofa-bed according to the invention the operation for converting the sofa into bed and viceversa is extremely simple and rapid while a structure of simple and inexpensive manufacture and yet effective and reliable is obtained.

Figure 18:
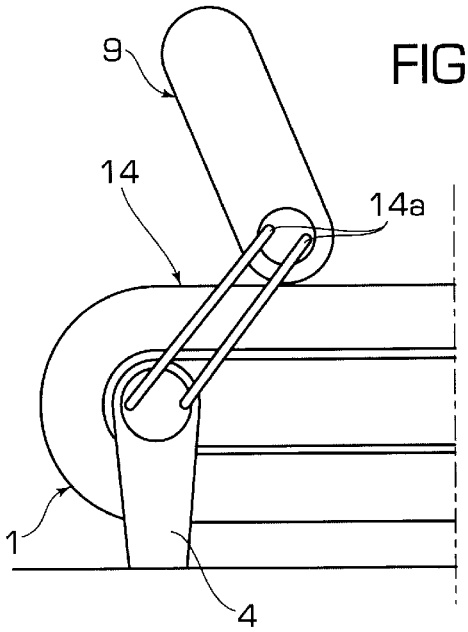
Figure 19:
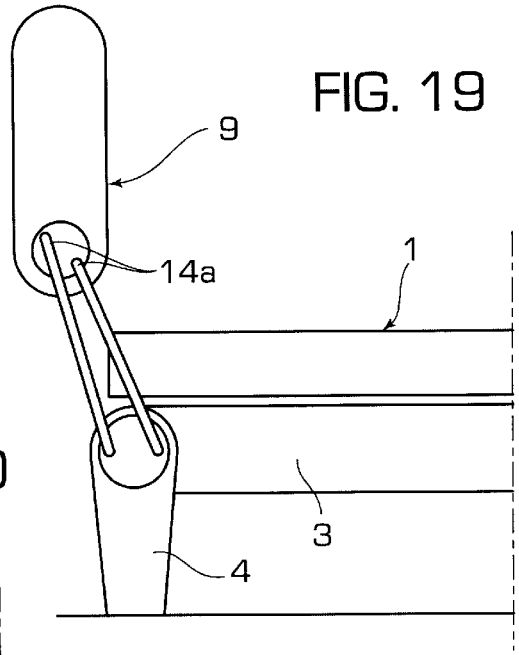
Figure 20:
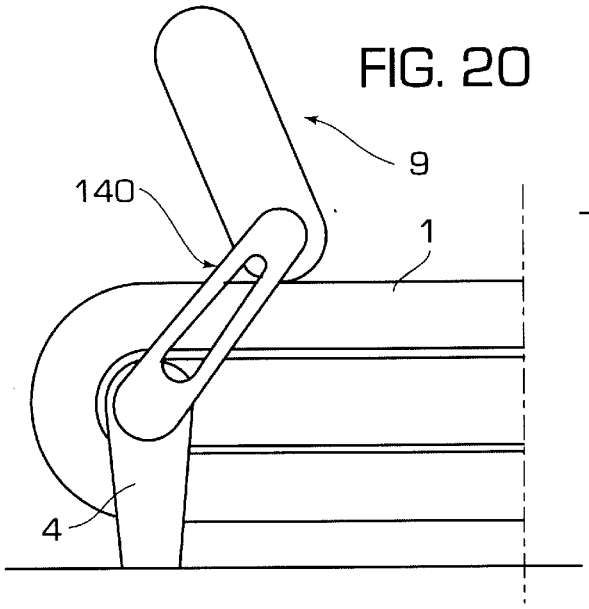
FIGS. 20, 21 show two alternative embodiments of structure covering the frame of the backrest of FIGS. 18, 19.
Figure 21:
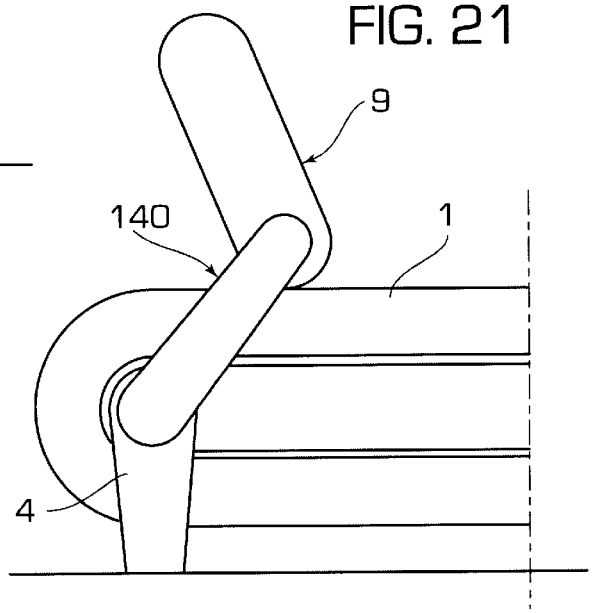

FIGS. 18, 19 show a variant of the frame of backrest 9, in which the parallelogram linkage 14 comprises two bars 14a having a circular cross-section and ends bent at 90° which are engaged within the upper portion of the backrest and the fixed structure of the sofa-bed. FIGS. 20, 21 show two alternative embodiments of the structure 140 covering the bars 14*a*.

Naturally, while the principle of the invention remains the same, the details of construction and the embodiments may widely vary with respect to what has been described and illustrated purely by way of example, without departing from the scope of the present invention.

What is claimed is:

1. Sofa convertible into bed, comprising a backrest and a seat portion which includes a supporting structure and mattress resting thereon, wherein said supporting structure of the sofa seat portion includes a fixed portion and a portion which is movable horizontally and forwardly with respect to the fixed portion, starting from a retracted position, corresponding to a shortened configuration of the supporting structure for use as sofa, up to a forwardly displaced position, corresponding to an extended configuration for the supporting structure, for use as bed, and wherein said mattress has one of its end portions anchored to said movable portion, in that it lies down over the supporting structure in the elongated condition of the latter for use as bed, whereas in the shortened configuration for use as sofa, said end portion of the mattress constitutes the sofa seat and the remaining porting of the mattress is folded under the supporting structure, wherein said fixed portion of the supporting structure includes means for guiding the mattress between its unfolded condition and its folded condition, and wherein said movable portion comprises two longitudinal beams connected to each other by cross-members and by a wall supporting a padded body which supports said end portion of the mattress.

2. Sofa convertible into bed, comprising a backrest and a seat portion which includes a supporting structure and mattress resting thereon, wherein said supporting structure of the sofa seat portion includes a fixed portion and a portion which is movable horizontally and forwardly with respect to the fixed portion, starting from a retracted position, corresponding to a shortened configuration of the supporting structure for use as sofa, up to a forwardly displaced position, corresponding to an extended configuration for the supporting structure, for use as bed, and wherein said mattress has one of its end portions anchored to said movable portion, in that it lies down over the supporting structure in the elongated condition of the latter for use as bed, whereas in the shortened configuration for use as sofa, said end portion of the mattress constitutes the sofa seat and the remaining porting of the mattress is folded under the supporting structure, wherein said fixed portion of the supporting structure includes means for guiding the mattress between its unfolded condition and its folded condition, wherein said fixed portion of the supporting structure includes an auxiliary supporting structure for the backrest, and wherein said backrest includes a foldable frame carried by said auxiliary supporting structure.

3. Sofa bed according to claim 2, wherein said foldable frame comprises a frame arranged inside the upper portion of the backrest and connected by a parallelogram linkage to said auxiliary supporting structure.

* * * * *